US010343892B2

(12) United States Patent
Achatz et al.

(10) Patent No.: US 10,343,892 B2
(45) Date of Patent: Jul. 9, 2019

(54) FILLING ADAPTER (AERATION LINE)

(71) Applicant: DÜRR SOMAC GmbH, Stollberg (DE)

(72) Inventors: Thomas Achatz, Niederdorf (DE); Eric Selbmann, Gersdorf (DE); Frank Wieland, Burkhardtsdorf (DE)

(73) Assignee: DÜRR SOMAC GmbH, Stollberg (DE)

( * ) Notice: Subject to any disclaimer, the term of this patent is extended or adjusted under 35 U.S.C. 154(b) by 286 days.

(21) Appl. No.: 15/129,770

(22) PCT Filed: Mar. 18, 2015

(86) PCT No.: PCT/DE2015/000138
§ 371 (c)(1),
(2) Date: Sep. 27, 2016

(87) PCT Pub. No.: WO2015/149738
PCT Pub. Date: Oct. 8, 2015

(65) Prior Publication Data

US 2017/0129765 A1 May 11, 2017

(30) Foreign Application Priority Data

Mar. 29, 2014 (DE) ..... 10 2014 004 824

(51) Int. Cl.
*B67D 7/02* (2010.01)
*B67D 7/42* (2010.01)
*B67D 7/04* (2010.01)

(52) U.S. Cl.
CPC ..... *B67D 7/42* (2013.01); *B67D 7/02* (2013.01); *B67D 7/0294* (2013.01); *B67D 7/04* (2013.01); *B67D 7/428* (2013.01)

(58) Field of Classification Search
CPC ..... B67D 7/02; B67D 7/0294; B67D 7/04; B67D 7/42; B67D 7/428
See application file for complete search history.

(56) References Cited

U.S. PATENT DOCUMENTS 4,708,175 A * 11/1987 Janashak ..... B25J 15/0019 141/1
4,805,417 A * 2/1989 Weaver ..... F16L 37/23 137/614

(Continued)

FOREIGN PATENT DOCUMENTS

DE 7833183 U1 9/1987
DE 3633872 C1 10/1987

(Continued)

OTHER PUBLICATIONS

International Search Report (English and German) for PCT/DE2015/000138, ISA/EP. Rijswijk, NL, dated Sep. 25, 2015.

(Continued)

*Primary Examiner* — Nicolas A Arnett
(74) *Attorney, Agent, or Firm* — Harness, Dickey & Pierce, P.L.C.

(57) ABSTRACT

A filling adapter for a container to be filled with media, in particular for the filling of containers on assembly lines for the production of motor vehicles where the filling adapter is equipped with a hose pack, electrical, pneumatic, and hydraulic lines. The filling adapter has a barrel and a ball piece and is operatively connected to two media lines in a hose pack, wherein the media are redistributed in the adapter head, in which a filling valve and a vacuum valve are arranged, which are each connected to the barrel, and wherein an aeration line branches off from a vacuum line in the hose pack by means of a check valve and is connected to the ball piece.

3 Claims, 1 Drawing Sheet

(56) References Cited

U.S. PATENT DOCUMENTS 4,881,581 A * 11/1989 Hollerback ..... B60K 15/04 141/113
4,889,149 A * 12/1989 Weaver ..... B60H 1/00585 137/1
5,060,703 A * 10/1991 Koerner ..... B60T 17/222 141/59
RE34,426 E * 11/1993 Weaver ..... F16L 37/12 137/614
5,785,082 A * 7/1998 Geis ..... F17C 13/04 137/516.29
6,196,280 B1 * 3/2001 Tate, Jr. ..... B60K 15/04 141/301
6,257,285 B1 * 7/2001 Robinson ..... F01P 11/0204 141/21
6,722,397 B2 * 4/2004 Few ..... B60S 5/00 141/18
6,799,614 B1 * 10/2004 Smith ..... B67D 7/42 141/287
8,631,836 B2 * 1/2014 Desaki ..... B67C 3/16 141/59
8,936,053 B2 * 1/2015 Ogerly ..... B60T 17/222 141/368
9,469,263 B2 * 10/2016 MacArthur ..... B60R 17/00
9,624,087 B2 * 4/2017 Tuyls ..... B67D 7/02
10,053,357 B2 * 8/2018 Achatz ..... B67D 7/425
2003/0164200 A1 * 9/2003 Czeranna ..... B62D 65/18 141/1
2012/0247615 A1 10/2012 Ogerly et al.
2017/0137279 A1 * 5/2017 Achatz ..... B67D 7/005
2017/0217754 A1 * 8/2017 Achatz ..... B67D 7/005

FOREIGN PATENT DOCUMENTS

DE 29620036 U1 1/1997
DE 19700436 A1 7/1998
FR 2911593 A1 7/2008
WO WO-2005/123572 A1 12/2005

OTHER PUBLICATIONS

Written Opinion of the ISA (German) for PCT/DE2015/000138, ISA/EP. Rijswijk, NL, dated Sep. 25, 2015.

* cited by examiner

FILLING ADAPTER (AERATION LINE)

CROSS-REFERENCE TO RELATED APPLICATIONS

This application is a national Phase of PCT International Application PCT/DE2015/000138 filed on Mar. 18, 2015. This application claims the benefit of and priority to German Patent Application No. 10 2014 004 824.1, filed on Mar. 29, 2014. The entire disclosures of each of the above applications are incorporated herein by reference.

FIELD

The disclosure relates to a filling adapter for a container to be filled with media (e.g. oils, gases, coolants and the like), in particular for the initial filling of containers with operating substances on assembly lines for the production of motor vehicles, wherein the filling adapter is equipped with a hose pack, electrical, pneumatic and hydraulic lines.

BACKGROUND

This section provides background information related to the present disclosure which is not necessarily prior art.

Containers must be filled with liquids or gases for numerous technical applications. A typical application in this respect are motor vehicles where housings, circuits, equalizing reservoirs and the like have to be filled with fuel, lubricants, coolants, and other operating substances. In the manufacturing process, these vehicles must be filled, for example, with brake fluid, power steering fluid, coolant, refrigerant, windshield wiper fluid, and fuel. These media are fed via hoses and special adapters to the respective circuits of the vehicles.

To perform the filling, a worker has to bring the adapter and hose pack to the vehicle depending on the respective position of the filling station and connect it to the ports of the circuits to be filled. The hoses typically include multiple lines with different functions for vacuum application, back suction, filling, aerating, as well as for electrical cables. These functions are implemented by special valve interconnections in the adapter head.

In a first variation that is considered to be state of the art, the filling and back suctioning functions are performed by means of a barrel and the vacuum and aeration functions are performed by a ball piece. This variant facilitates a simple switching configuration. In addition, it requires only two valves in the filling adapter and only two media lines in the hose pack. It is a disadvantage, however, that a large cross section has to be pulled twice (1× for filling, 1× for vacuum) into the container to be filled. This inevitably results in a limitation of the potential cross section.

In a second variation that is considered to be state of the art, involves vacuuming, filling and back suctioning functions using a barrel. Only the aeration function is performed by a ball piece. A major advantage of this variant is that the large cross section only has to be pulled once into the container to be filled. This results in a considerable increase of the potential cross section. But the more complex configuration is a disadvantage. It requires three valves in the adapter head and three media lines in the hose pack as well as an additional valve in the system. Regardless of the extra cost, these additional valves are also additional interfering sources for the functioning of the filling station.

SUMMARY

This section provides a general summary of the disclosure, and is not a comprehensive disclosure of its full scope or all of its features.

The purpose of this disclosure is to create a technical solution by means of which the technical and economic advantages of the two known general approaches to a solution can be combined without generating additional disadvantages.

This problem is solved in that the filling adapter comprises a barrel and a ball piece and is operatively connected to two media lines in a hose pack, wherein the media are redistributed in the adapter head, in which a filling valve and a vacuum valve are arranged, which are each connected to the barrel, and wherein an aeration line branches off from a vacuum line in the hose pack by means of a check valve and is connected to the ball piece.

When in operation, the vacuum valve is opened during evacuation and the check valve remains closed. Hence the vacuum is pulled over the barrel. During aeration, however, the aeration pressure is applied to the vacuum line within the hose pack, wherein the vacuum valve remains closed and the check valve is opened. This causes the aeration pressure to flow via the ball piece into the container.

The technical solution according to the disclosure advantageously combines technical and economic advantages of known approaches to a solution while the detailed design proposed was not obvious to a person skilled in the art.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
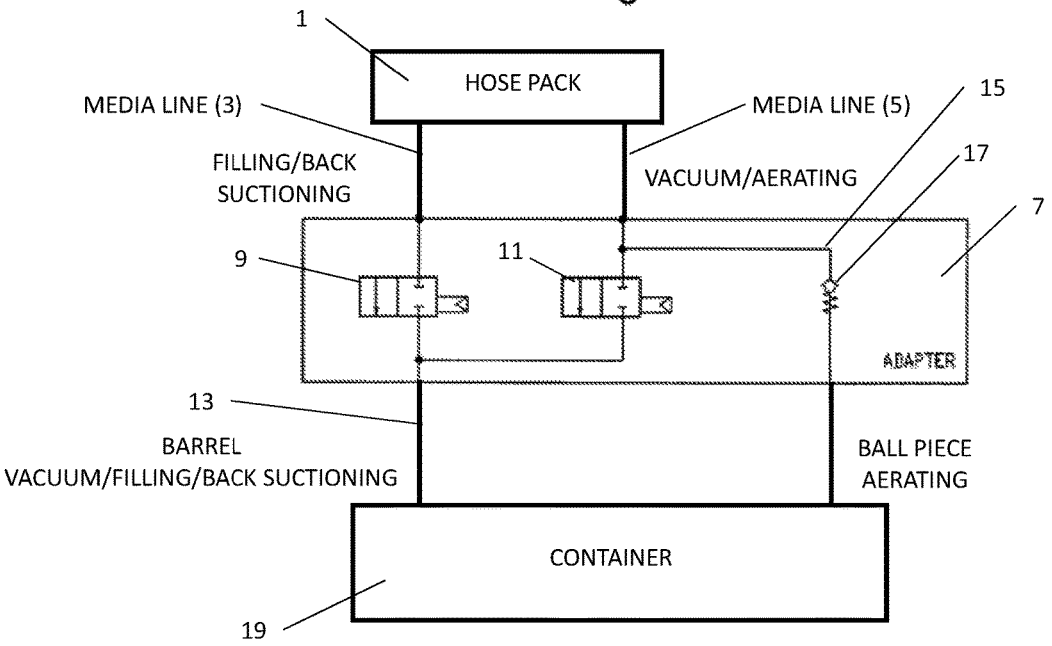
FIG. 1 shows a stylized representation of the fundamental switching configuration of the components.
Figure 2:
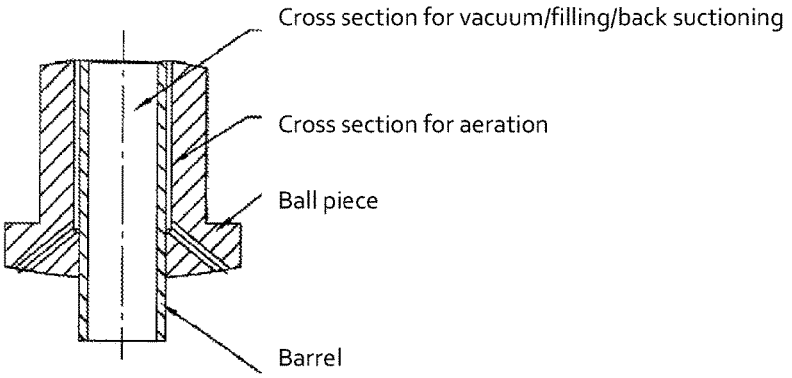
FIG. 2 shows a cross section of the components that are significant for the present disclosure and their arrangement relative to one another.

Example embodiments will now be described more fully with reference to the accompanying drawings.

The hose pack 1, the construction of which is well-known and so it is not shown in detail here, contains two media lines 3, 5, wherein the media are redistributed in an adapter head 7. Two valves 9, 11 are mounted in the adapter head 7, a filling valve 9 and a vacuum valve 11. These two valves are connected to a barrel 13. An aeration line 15 branches off from the vacuum line 5 in the hose pack 1 and is connected to a ball piece 17.

During evacuation, the vacuum valve 11 is opened. The check valve 17 remains closed. The vacuum is pulled over the barrel 13.

During aeration, the aeration pressure is applied to the vacuum line in the hose pack 1. The vacuum valve 11 remains closed. The check valve 17 opens. The aeration pressure flows into the container 19 via the ball piece 17.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The invention claimed is:

1. A filling adapter for the initial filling of containers with operating substances on assembly lines for the production of motor vehicles, wherein the filling adapter is equipped with a hose pack including electrical, pneumatic and hydraulic lines, wherein the filling adapter comprises a barrel and a ball piece and is operatively connected to two media lines in the hose pack, wherein the operating substances are redistributed in an adapter head, in which a filling valve and a vacuum valve are arranged, which are each connected to the barrel, and wherein an aeration line branches off from a vacuum line in the hose pack by moans of a check valve and is connected to the ball piece.

2. The filling adapter according to claim 1, wherein the vacuum valve is opened and the check valve remains closed during evacuation, such that the vacuum is pulled over the barrel.

3. The filling adapter according to claim 1, wherein the aeration pressure is applied to the vacuum line in the hose pack during aeration, wherein the vacuum valve remains closed and the check valve opens, such that the aeration pressure flows via the ball piece into the container.

* * * * *